US009309474B2

(12) United States Patent
Augier et al.

(10) Patent No.: US 9,309,474 B2
(45) Date of Patent: Apr. 12, 2016

(54) METHOD OF INCORPORATING ALCOHOL INTO FUELS HAVING A HIGH AROMATIC COMPOUND CONTENT

(75) Inventors: Frederic Augier, Saint Symphorien d Ozon (FR); Cecile Barrere-Tricca, Soucieu en Jarrost (FR); Arnaud Baudot, Vernaison (FR); Pierre Boucot, Ternay (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 1837 days.

(21) Appl. No.: 12/666,668

(22) PCT Filed: Jun. 26, 2008

(86) PCT No.: PCT/FR2008/000911

§ 371 (c)(1),
(2), (4) Date: Jun. 21, 2010

(87) PCT Pub. No.: WO2009/016290

PCT Pub. Date: Feb. 5, 2009

(65) Prior Publication Data

US 2010/0263264 A1 Oct. 21, 2010

(30) Foreign Application Priority Data

Jun. 27, 2007 (FR) ..... 07 04673

(51) Int. Cl.
*C10L 1/185* (2006.01)
*C10L 1/182* (2006.01)
(Continued)

(52) U.S. Cl.
CPC ..... *C10L 1/1857* (2013.01); *C10L 1/026* (2013.01); *C10L 1/04* (2013.01); *C10L 1/06* (2013.01); *C10L 1/08* (2013.01); *C10L 1/1824* (2013.01)

(58) Field of Classification Search
USPC ..... 44/438, 446, 453; 203/19
See application file for complete search history.

(56) References Cited

U.S. PATENT DOCUMENTS 2,591,672 A * 4/1952 Catterall ..... 44/438
4,251,231 A 2/1981 Baird
(Continued)

FOREIGN PATENT DOCUMENTS

GB 2 293 375 A 3/1996

OTHER PUBLICATIONS

Abstract for JP06-158064 A, Jun. 7, 1994, Mitsubishi Heavy Ind. Ltd.
(Continued)

*Primary Examiner* — Ellen McAvoy
*Assistant Examiner* — Chantel Graham
(74) *Attorney, Agent, or Firm* — Millen, White, Zelano & Branigan, P.C.

(57) ABSTRACT

The method allows to incorporate an alcohol or a mixture of alcohols into fuels by minimizing the energy expenditure linked with the prior production of the alcohol or of the mixture of alcohols. One or more bases of the fuel, to which an oxygen-containing compound or a mixture of oxygen-containing compounds have possibly been added, are used to extract the alcohol or the alcohol mixture contained in aqueous solutions produced by biomass fermentation processes. After adjusting the temperature of the aqueous solution stream and of the stream containing one or more bases of the fuel through exchangers, these streams are fed into an extractor. The extract leaving the extractor is then dried and/or an oxygen-containing compound or a mixture of oxygen-containing compounds is added thereto. The raffinate leaving the extractor is sent to a water treating plant or recycled. The stream of dried fuel to which an oxygen-containing compound or a mixture of oxygen-containing compounds has possibly been added is sent to be stored. The water leaving the drying stage is sent to a water treating plant or recycled.

21 Claims, 4 Drawing Sheets

(51) Int. Cl.

| | |
|---|---|
| ***C10L 1/02*** | (2006.01) |
| ***C10L 1/04*** | (2006.01) |
| ***C10L 1/06*** | (2006.01) |
| ***C10L 1/08*** | (2006.01) |

(56) References Cited

U.S. PATENT DOCUMENTS

| | | | | |
|---|---|---|---|---|
| 4,297,172 | A * | 10/1981 | Kyle | 203/19 |
| 4,441,891 | A | 4/1984 | Roth | |
| 4,445,908 | A | 5/1984 | Compere et al. | |
| 4,482,768 | A | 11/1984 | Somekh | |
| 5,113,024 | A | 5/1992 | Harandi et al. | |

OTHER PUBLICATIONS

International Search Report of PCT/FR2008/000911 (Feb. 9, 2009).

* cited by examiner

METHOD OF INCORPORATING ALCOHOL INTO FUELS HAVING A HIGH AROMATIC COMPOUND CONTENT

FIELD OF THE INVENTION

The present invention relates to a method of incorporating alcohol or a mixture of alcohols obtained from aqueous solutions generated by biomass fermentation processes into a fuel.

The biomass groups together all of the organic, vegetable or animal matters, notably:

Dedicated crops:

- sugar plants (sugar beet, sugar cane, sugar sorghum . . . ),
- amylaceous plants (wheat, corn, barley, potato . . . ),
- pluriannual-harvest lignocellulosic plants (lucerne, fescue . . . ), annual-harvest lignocellulosic plants (miscanthus, fibre sorghum, triticale, kenaf, phalaris, arundo . . . ), short rotation or very short rotation coppice (poplar, willow, eucalyptus . . . ), Coproducts and residues of such crops: straw and stalk, forest wastes, bagasse . . . , Vegetable residues: slash residues, pruning residues . . . , Residues from various activities: paper mills, wood pulp plants, sawmills, some industrial waste types . . . .

The alcohols produced by biomass fermentation processes preferably are ethanol, produced through ethanolic fermentation, and butanol, as well as the ABE (acetone-butanol-ethanol) mixture produced through acetonobutylic fermentation.

The current European legislation authorizes addition of oxygen-containing compounds to fuels. In the case of gasolines, for example, the maximum oxygen content is 2.7 mass %, the ethanol content being furthermore limited to 5 vol. %, the butanol content to 10 vol. %, the methanol content to 3 vol. %, and the proportion of ether with 5 carbon atoms and more per molecule is limited to 15 vol. %.

Alcohol has to meet some characteristics to be incorporated into fuels. In the case of gasolines, in order to prevent demixing phenomena during storage, the ethanol that is incorporated has to be quasi anhydrous: the European standard regarding the water content of ethanol for incorporation into gasolines is 99.7 wt. % of ethanol minimum, i.e. 99.8 vol. % minimum. The European standards indicate that diesel fuels must contain 200 ppm water maximum.

BACKGROUND OF THE INVENTION

In the current state of the technique, the preparation of anhydrous ethanol from aqueous solutions first involves producing an ethanol/water mixture containing 95 vol. % of ethanol, the ethanol/water mixture making up an azeotrope containing 95.6 wt. % of ethanol at 0.1 MPa. This operation involving a distillation process is a highly energy-consuming operation. For example, starting from an aqueous solution containing about 10 vol. % of ethanol, approximately 180 kg steam per hectoliter of ethanol are necessary to obtain this mixture.

After this first distillation stage, several options can be considered for drying the aqueous ethanol solution from about 95 vol. % to at least 99.8 vol. %:

- azeotropic distillation in the presence of a third body (benzene or cyclohexane for example),
- membrane pervaporation,
- molecular sieve adsorption.

The option using azeotropic distillation in the presence of benzene or cyclohexane involves a high energy expenditure since it requires about 110 kg steam and about 1.3 kWh per hectoliter of alcohol. Furthermore, the toxicity of benzene and cyclohexane is a major drawback of this process.

The option using membrane pervaporation is clearly more interesting as regards energy expenditure since it consumes only about 30 kg steam and about 4.5 kWh per hectoliter of alcohol produced.

Molecular sieve adsorption is a moderately energy-consuming operation that requires about 30 to 60 kg steam and about 2 to 3 kWh per hectoliter of alcohol in the case of a PSA (Pressure Swing Adsorption) process with adsorption in the vapour phase.

Alcohols being generally partly soluble in most liquids, it is obvious that any contacting operation between an aqueous phase containing an alcohol and another liquid phase containing none induces extraction of a non-zero fraction of the alcohol from the aqueous phase to the other liquid phase. U.S. Pat. No. 4,455,198 and U.S. Pat. No. 4,346,241 describe methods of preparing anhydrous ethanol wherein a liquid-liquid extraction is carried out with cyclic ketones or alcohols on the one hand, or amines on the other hand.

The possibility of extracting ethanol with gasoline has already been considered in the past, as mentioned in U.S. Pat. No. 4,297,172. In the temperature range studied and with the gasoline type used, extraction is relatively difficult so that it is considered only from a highly alcohol-enriched aqueous phase. The method described in this patent application allows to do without the extremely energy-consuming stage of azeotropic distillation that is commonly carried out. In the first stage of this process, the ethanol-containing aqueous phase is however subjected to distillation in order to concentrate the ethanol and to obtain a distillation comprising at least 75 wt. % of ethanol. This essential first concentration stage makes the process still too energy-consuming a method. Furthermore, the final yields are relatively low since this method allows to extract only 5 to 17 wt. % of ethanol.

SUMMARY OF THE INVENTION

Surprisingly enough, the applicant has observed that azeotropic distillation can be avoided while obtaining good-quality products.

In order to achieve a yet more favourable alcohol extraction as regards energy consumption, requiring no preliminary concentration stage and allowing extraction of the major part of the alcohol from the aqueous solution, the present invention provides a new process scheme allowing to achieve extraction directly with a fuel having a high aromatic compound content. Unlike distillation, extraction requires no steam expenditure. The energy expenditure is then only of electrical nature. It is linked with contacting and mixing of the fluids in the extractor, and with the pressure drops undergone by the fluids in this device.

The method according to the invention allows alcohol to be directly incorporated into the fuel without any preliminary distillation stage, which allows to greatly reduce energy expenditures.

DETAILED DESCRIPTION

Figure 1:
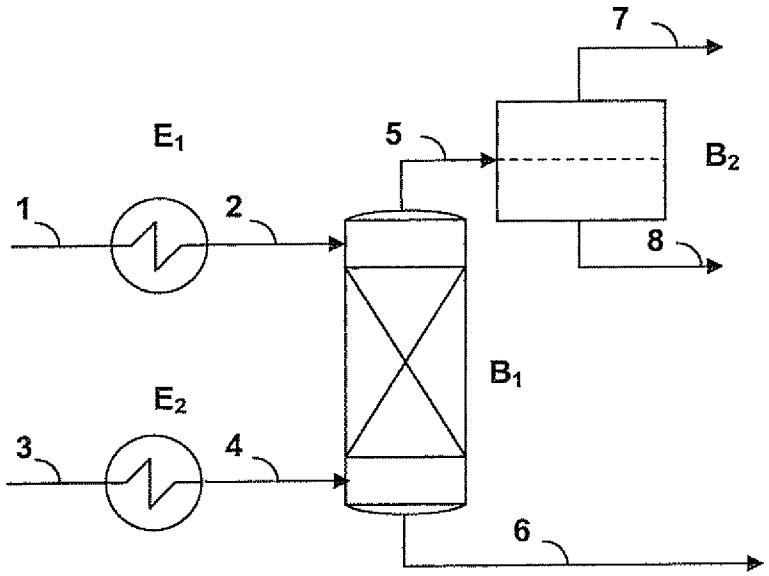
FIG. 1 shows a diagram of the method according to the present invention.

The present invention describes a method of incorporating alcohol or a mixture of alcohols into fuels having a high aromatic compound content selected from a reformate gasoline cut, a pyrolysis gasoline cut or an LCO type diesel fuel, comprising:

a stage of liquid-liquid extraction of the alcohol by at least one or more fuel bases, by directly contacting an aqueous phase containing the alcohol or the alcohol mixture and a hydrocarbon phase consisting of said fuel base, and a stage of drying the fuel base enriched in alcohol or alcohol mixture.

The fuel into which the alcohol or the mixture is incorporated has an aromatic compound content of at least 70 wt. %. Preferably, the fuel has an aromatic compound content above 80 wt. %.

The gasoline selected is preferably a reformate gasoline cut (thus obtained from the refining process referred to as reforming) or a pyrolysis gasoline cut (steam cracking by-product) characterized by a high aromatic compound content. This type of gasoline allows to carry out a much more favourable extraction than with a gasoline obtained by mixing cuts from various refining processes. In fact, extraction of the alcohol is much less efficient if the aromatic content of the gasoline is low.

The diesel fuel selected is preferably an LCO type diesel fuel from catalytic cracking units, also characterized by a high aromatic content.

The alcohol or the alcohol mixture comes from any biomass fermentation process and it is more particularly selected from among ethanol, butanol or the acetone-butanol-ethanol (ABE) mixture.

An oxygen-containing compound or a mixture of oxygen-containing compounds can be optionally added to the fuel, which allows to further improve the alcohol extraction efficiency. These oxygen-containing additives are preferably:

ethers, for example ETBE (ethyltertiobutylether), MTBE (methyltertiobutylether), TAEE (tertioamylethylether), TAME (tertioamylmethylether), DIPE (diisopropylether), C7 ethers such as MEPEME (2-methyl-2-methoxypentane) or DIMEBU (2,3-dimethyl-2-methoxybutane), PTBE (n-propyl tertiobutylether), IPTBE (isopropyltertiobutylether), DPE (dipropylether), or alcohols, for example butanol, TBA (terbutylic alcohol), IPA (isopropylic alcohol), isobutylic alcohol and/or methanol.

The extraction stage is carried out by direct contact between the aqueous phase containing the alcohol or the alcohol mixture and the hydrocarbon phase consisting of one or more fuel bases.

The aqueous phase can contain 1 to 99 vol. % of alcohol or alcohol mixture. Preferably, the aqueous phase contains 1 to 30 vol. % of alcohol or alcohol mixture. More preferably, it contains between 5 and 15 vol. % of alcohol or alcohol mixture.

Said aqueous phase containing the alcohol or the alcohol mixture is introduced at the top of the extraction column and said hydrocarbon phase containing the fuel base is introduced at the bottom of the extraction column.

The aqueous phase and the hydrocarbon phase can be introduced into the extraction column at identical or different temperatures. Advantageously, the hydrocarbon phase can be used for heating the aqueous phase.

Extraction is all the more favoured as the temperature is high. The extraction stage is carried out at a temperature ranging between the ambient temperature and 320° C., preferably between 50° C. and 250° C., more preferably between 70° C. and 200° C.

The pressure in the extractor preferably ranges between the atmospheric pressure and 10 MPa, preferably between the atmospheric pressure and 1 MPa.

Advantageously, the extraction stage is carried out by circulating the two phases countercurrent in devices promoting dispersion, contacting and material exchange between the aqueous phase and the hydrocarbon phase.

In cases where an oxygen-containing compound is added to the fuel, the latter can be introduced with the hydrocarbon phase at the bottom of the column, or separately, at an intermediate height. Thus, the lower part of the extraction column located below the intermediate injection point behaves like a counter-extraction section for the oxygen-containing product that has entered the aqueous phase. This device advantageously allows to limit the possible oxygen-containing product losses.

At the end of the extraction stage, an extract consisting of the fuel base containing an alcohol or an alcohol mixture and part of the water from the aqueous solution is obtained, as well as a raffinate.

The raffinate is sent to a water treating plant and/or it is recycled, for example upstream to the biomass fermentation process, and the extract containing the alcohol-enriched hydrocarbon phase is sent to the drying stage. In fact, the presence of this water may lead to demixing of the alcohol through cooling of the alcohol solution during storage. In order to prevent this demixing phenomenon, the hydrocarbon phase containing the alcohol and the water consequently has to be dehydrated and/or cooled (drying).

In the sense of the present invention, drying is understood as any method allowing extraction of a fraction of the water content of a mixture. Drying can be carried out for example using the techniques mentioned below or through cooling leading to water demixing.

The drying stage can be advantageously carried out by adsorption on a molecular sieve, by pervaporation through membranes or by distillation, the first two options being preferably used, notably for reasons of lower energy consumption.

The molecular sieves used for drying alcohols are generally zeolite type adsorbents, i.e. oxides having a three-dimensional structure resulting from the grouping of tetrahedral units leading to a network of channels of molecular dimension and of pore diameter ranging between 3 and 10 Å. A zeolite is typically a silico-aluminate and it is commonly extended to other compositions leading to a uniform three-dimensional structure, notably a metallo-silicate such as, for example, an alumino-silicate, a boro-silicate, a ferro-silicate, a titano-silicate, a gallo-phosphate or a silico-alumino-phosphate. The zeolites used for dehydrating ethanol preferably have a pore size of the order of 3 Å in diameter and they have the shape of balls or rods. This opening is too small to allow passage of the ethanol whose diameter is of the order of 4.4 Å. On the other hand, the water molecules have a diameter of the order of 2.8 Å and they can therefore enter the pores of the zeolites and be adsorbed therein.

By way of example, the following zeolites can be used: the SILIPORITE® products of the CECA Company or the SYLOBEAD® products of the GRACE Davison Company.

The adsorbent molecular sieve can also be a silica.

The molecular sieves are arranged in columns working intermittently in two stages:

an adsorption stage during which the mixture in liquid or vapour form flows through the column laden with molecular sieve. A liquid or a vapour freed of the body retained by the molecular sieve is recovered at the outlet. This first stage is stopped when the adsorbent is saturated. Adsorption is preferably carried out in the liquid phase, a desorption stage allowing to regenerate the molecular sieve and to make it usable again for a new adsorption stage. This stage allows the adsorbate to be recovered.

There are two regeneration processes: temperature difference regeneration or TSA (Temperature Swing Adsorption) and pressure difference regeneration or PSA (Pressure Swing Adsorption). In the case of alcohol drying, adsorption in the vapour phase is generally preferred and pressure difference regeneration is the desorption mode that is generally selected. In fact, the TSA process requires a neutral purge gas, long regeneration sequences and it also involves problems of degradation of the solid generated by thermal cycles (expansion-contraction). A description of this type of alcohol dehydration through adsorption in the vapour phase on molecular sieve of PSA type is given, for example, in patent FR-2,719,039-B1.

This drying process through adsorption in the vapour phase on molecular sieve requires prior vaporization of the alcohol or of the alcohol mixture. During the regeneration or desorption stage, the capacity that has collected the water is placed under vacuum.

In the case of the present invention, a mode of drying the hydrocarbon phase enriched in alcohol or alcohol mixture by adsorption can be advantageously carried out by circulating, in an adsorbent-filled column, a dry alcohol-free fuel base coming directly from its production plant, possibly heated or cooled.

The stage of drying the hydrocarbon phase containing the alcohol or the alcohol mixture and water can also be carried out by membrane pervaporation. This technology is based on the selective transfer of water through a selective layer associated with a vaporization of the water at the level of the downstream face of the membrane. This vaporization is induced by placing the compartment downstream from the membrane under vacuum, combined with condensation of the steam thus produced at the level of a cold point. The water flux density is directly proportional to the steam pressure difference between the two faces of the membrane. The steam pressure upstream from the membrane (feedstock side) depends on the composition of the feedstock and on the temperature of said feedstock. Similarly, the partial water pressure downstream from the membrane generally depends on the cold level applied at the level of the condenser, except for the pressure drops in the steam circuit. This technology is particularly advantageous because the energy required for separation is reduced only to the water vaporization enthalpy downstream from the membrane.

Several membrane materials can be used. Two commercial options are currently available on the market and they can be advantageously used in the present invention:

membranes based on A or T zeolites, marketed by the Japanese Mitsui Engineering & Shipbuilding Company. These membrane materials whose synthesis is described in U.S. Pat. No. 5,554,286 and U.S. Pat. No. 6,159,542 are the preferred option for the present invention. These membranes are in fact known to provide a very high water/ethanol selectivity, of the order of 30,000. Furthermore, it has been shown that these membranes can be operated for a long time at high temperatures of the order of 110° C. or even 120° C. (Morigami et al., *Separation and Purification Technology* 25 (2001) 251-260). During long-term tests carried out in the latter reference, the Mitsui membrane showed a capacity to dehydrate industrial ethanol feedstocks containing about 8% water up to water levels of the order of 0.05%. An industrial ultimate ethanol dehydration plant located in Karya (Japan) and based on the same membrane type allows to reduce the water content of this alcohol from 10% to 0.2% (mass fraction). This plant allows to treat 600 L/h feedstock with a useful membrane surface area of 60 $m^2$. Owing to the mineral nature of the selective layer of this membrane type, it is quite conceivable to be able to operate it at higher temperatures of the order of 150° C. The water permeability of this membrane type is inevitably very high, which results in a decrease in the surface area required for the desired dehydration. Besides, this membrane type is very resistant to all types of possible organic contaminants. Finally, zeolites of A or T type are completely impervious to all the hydrocarbon constituents characteristic of a reformate, dense membranes based on hydrophilic polymers of polyvinyl alcohol type (marketed by Sulzer Chemtec, Switzerland). The polymeric nature used in the selective layer of the membrane reduces the operating temperature to a maximum value limited to 80° C. This limitation in terms of operating temperature however leads to lower performances in terms of flow and dehydration level than in the case of the zeolite membrane marketed by Mitsui. Finally, these membranes can be sensitive to some forms of organic poison present as traces in industrial ethanol feedstocks (higher alcohols, esters, ketones) that will degrade the selective layer of this membrane type in the long term.

Other types of membrane materials based on hydrophilic vitrous polymers have also been tested at pilot scale for solvent dehydration and they can be advantageously used for the present invention: polyimides (Huang et al., *J. Appl. Polymer Sci.,* 85 (2002) 139-152), or polymer mixtures containing polyimides (Cranford et al., *J. of Membrane Sci.,* 155 (1999) 231-240), cellulose acetate, polysulfones or polyethersulfones.

Membrane materials based on microporous silica, as described in *J. of Membrane Science* 254 (2005) 267-274, can also be used.

Pervaporation on membranes is a very interesting option as regards "energy expenditure". However, this method can lead to high operating costs in the case of polymer membranes because of their sensitivity to impurities that may be contained in industrial feedstocks. It furthermore requires using a powerful refrigerating set for minimizing the steam pressure downstream from the membrane.

Once the extraction and drying stages completed, the fuel base is enriched in alcohol or alcohol mixture and it can be mixed with other cuts so as to form a marketable fuel. It is however necessary for the residual water content of the final gasoline to be low enough not to generate demixing during storage.

According to an embodiment of the present invention, the extract is subjected to cooling allowing demixing of an aqueous phase containing alcohol, that can be recycled to the extraction column.

The constraint linked with the residual water content in the final gasoline has to be taken into account during the drying stage and/or upon incorporation of stabilizing additives.

In fact, the drying stage can be optionally complemented by adding oxygen-containing compounds to the fuel base enriched in alcohol or alcohol mixture. These oxygen-containing compounds are identical to those that can be added to the fuel base to improve the liquid-liquid extraction efficiency. They preferably are:

ethers, for example ETBE (ethyltertiobutylether), MTBE (methyltertiobutylether), TAEE (tertioamylethylether), TAME (tertloamylmethylether), DIPE (diisopropylether), C7 ethers such as MEPEME (2-methyl-2-methoxypentane) or DIMEBU (2,3-dimethyl-2-methoxybutane), PTBE (n-propyl tertiobutylether), IPTBE (isopropyltertiobutylether), DPE (dipropylether), or alcohols, for example butanol, TBA (terbutylic alcohol), IPA (isopropylic alcohol), isobutylic alcohol and/or methanol.

FIG. 1 shows an embodiment of the method according to the present invention.

The aqueous phase containing the alcohol or the alcohol mixture is fed through line 1 into an exchanger E1 in order to be brought to the extraction temperature. It is thereafter sent to extractor B1 through line 2.

The hydrocarbon phase, i.e. the fuel base, is fed countercurrent to the aqueous phase into this device through line 4. It has first entered exchanger E2 through line 3 to be brought to the extraction temperature.

The temperatures of the two phases can be different. The fuel base can advantageously allow to heat the aqueous solution.

The extractor contains devices intended to promote dispersion and contacting of the aqueous and hydrocarbon phases, as well as material exchange between these two phases. Many countercurrent extraction technologies can thus be potentially applied to achieve extraction: battery of mixers-decanters, centrifuges, gravitational flow column (or sequence of columns). In the latter case, the column can be empty (spray column) or preferably equipped with internals of perforated plate, disc and crown, downcomer tray type. The column can be stirred by liquid or internals pulsation, or preferably by rotary mechanical agitation. The columns can also be filled with various packings of random or stacked type.

Two new phases are obtained at the extractor outlet: an extract and a raffinate. The extract contains the major part of the hydrocarbons, a significant part of the alcohol extracted from the aqueous phase and part of the water from this aqueous phase. It leaves the extractor through line 5 and it is sent to the drying stage.

The raffinate that predominantly consists of water also contains traces of hydrocarbons and the rest of the alcohol that has not been extracted. It is sent through line 6 to a water treating plant or it is recycled for example to the biomass fermentation process.

The drying stage produces water that is sent through line 8 to a water treating plant or recycled, for example to the alcoholic fermentation process, and the dried hydrocarbon phase containing the extracted alcohol flowing from line 7. This hydrocarbon phase is sent to the gasoline pool of the refinery.

Figure 2:
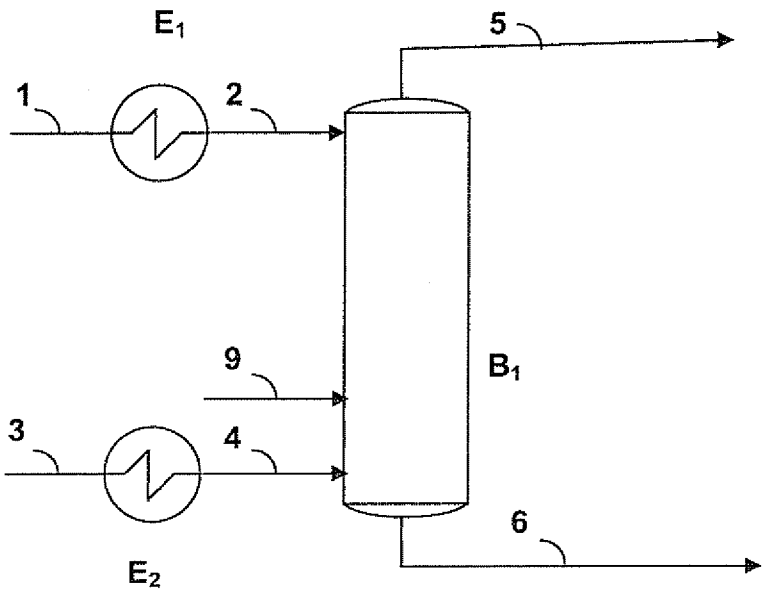
FIG. 2 shows an embodiment of the method according to the present invention wherein an oxygen-containing compound is introduced at an intermediate height into the extraction column.

If an oxygen-containing compound is added to the fuel base to promote extraction, and if the compound is mixed therewith prior to entering the extraction device, part of this compound may be extracted by the aqueous phase as a result of its partial or total solubility in water. In order to overcome a possible problem, one solution consists in introducing the added oxygen-containing compound at an intermediate height in the extraction column. A counter-extraction is thus achieved between the aqueous phase enriched in oxygen-containing compound and the fuel base. This embodiment is described in FIG. 2.

Device B1 described here is an extraction column supplied at the top with the aqueous solution containing the alcohol or the alcohol mixture 2, at the bottom with the fuel base 4, and an intermediate feed point 9 is used for the oxygen-containing compound or the mixture of oxygen-containing compounds. The aqueous raffinate leaves the column at the bottom 6 and the extract enriched in alcohol and in oxygen-containing compound(s) flows from the column at the top 5. The intermediate feed point is preferably located far enough from the column bottom for at least one theoretical extraction stage to separate it from the raffinate outlet.

Figure 3:
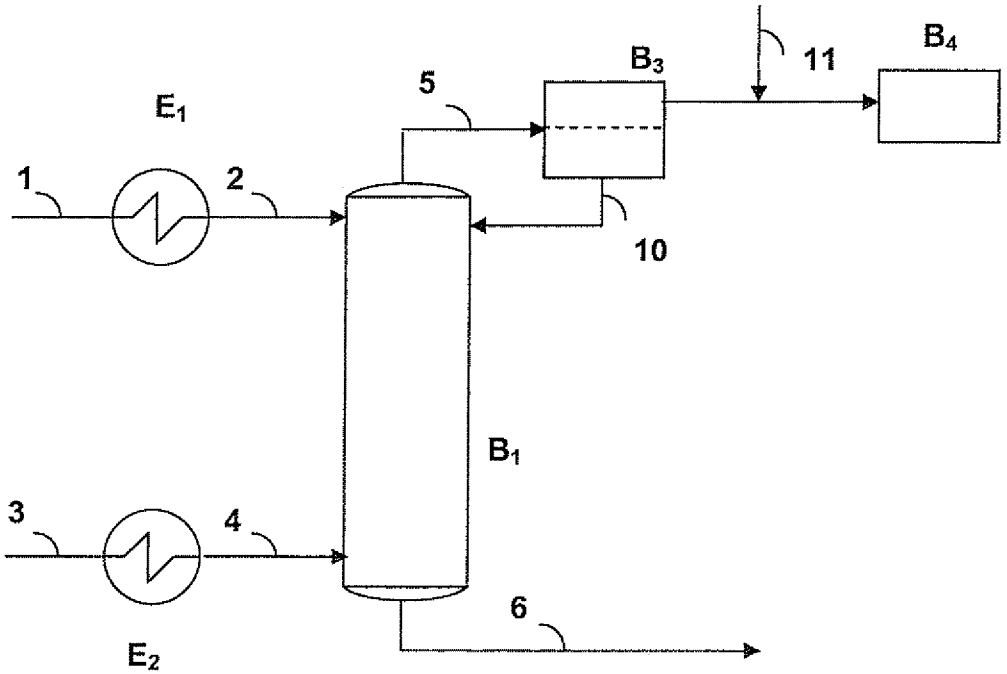
FIG. 3 shows an embodiment of the method according to the present invention wherein the drying stage consists in cooling, leading to demixing of an aqueous phase.

Another particular embodiment is diagrammatically shown in FIG. 3. It consists in carrying out the liquid-liquid extraction in an enclosure B1 between fuel base 4 and aqueous solution 2 containing the alcohol or the alcohol mixture. The alcohol-depleted raffinate 6 leaves the extraction column at the bottom thereof while extract 5 flows out at the top. The latter is cooled in a tank B3 to a sufficiently low temperature to cause demixing of an alcohol-containing aqueous phase 10. This phase can be recycled to the extraction column. An oxygen-containing additive 11 allowing demixing to be limited is then added to the partly dried extract. The cut can then be stored in a tank B4 at a lower temperature than in tank B3, without aqueous phase formation risks. The minimum temperature of the tank depends on both the nature of the additive, the amount added and the composition of the cut at the outlet of tank B3 (notably water and alcohol content). This embodiment is particularly interesting because it requires in principle no additional drying operation. It is therefore very economical compared to other alcohol incorporation means from alcohol-containing aqueous solutions.

Figure 4:
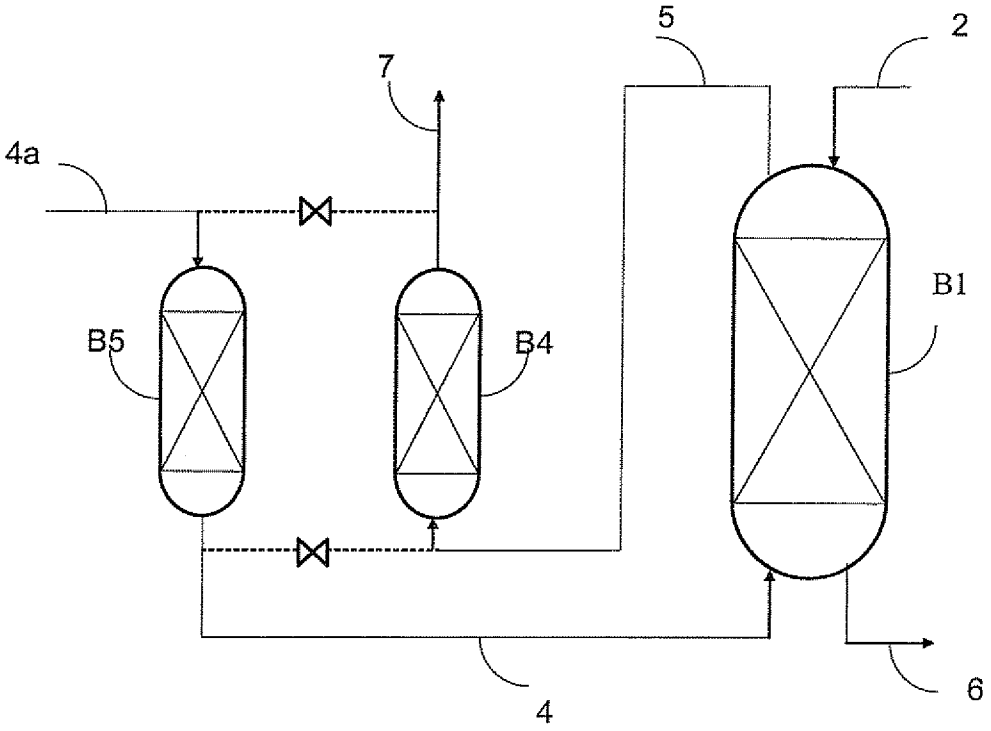
FIG. 4 shows an embodiment of the method according to the present invention wherein the drying stage is carried out by adsorption, by circulating dry fuel from the production unit.

The embodiment of the method according to the invention described in FIG. 4 consists of a particular mode of drying by adsorption in the liquid phase the fuel base after liquid-liquid extraction. At the outlet of extractor B1, extract 5 corresponding to the alcohol-enriched wet fuel base is dried by passage through a suitable solid bed (3A zeolite or silica for example) contained in a column B4. The alcohol-free dry fuel base coming from the production unit producing said fuel base, possibly heated or cooled, is sent through line 4*a* into a column in regeneration phase B5. The fuel base then enriched in water is thereafter sent through line 4 to the liquid-liquid extraction column where it becomes laden with alcohol and possibly water. The alcohol-rich dry fuel base is extracted through line 7 and sent to the gasoline pool of the refinery. The system works with at least two columns, one being in adsorption phase while the other is in regeneration phase. A preferred embodiment of the method consists in having at least two or three columns in regeneration mode and one column in adsorption mode.

Example 1

According to the Invention

The ethanol of a 10 vol. % aqueous solution is to be incorporated into a gasoline.

Extraction is carried out using a reformate containing about 80 wt. % aromatic compounds at a temperature of 210° C. that will later be sent to the gasoline pool.

The aqueous phase flow rate is 21,400 kg/h. The reformate flow rate is 80,000 kg/h.

Prior to being fed into the extractor, the aqueous solution and the reformate are brought to a temperature of 150° C.

Drying device B2 is a hydrophilic membrane operating on a pervaporation basis.

The extraction balance is given in Table 1.

TABLE 1

| | Aqueous sol. to be treated | Reformate | Extract | Raffinate |
|---|---|---|---|---|
| T (° C.) | 150 | 150 | 150 | 150 |
| P (bars) | 17 | 17 | 17 | 17 |
| EtOH (kg/h) | 1736 | 0 | 1641 | 95 |
| Water (kg/h) | 19,663 | 0 | 2924 | 16,739 |
| Reformate (kg/h) | 0 | 80,000 | 79,992 | 8 |
| TOTAL (kg/h) | 21,399 | 80,000 | 84,557 | 16,842 |
| ratio aqueous sol/ reformate | 0.27 | | | |
| % EtOH extracted | 95 | | | |
| % water extracted | 15 | | | |

The extractor used is a countercurrent multistage RDC type column (i.e. equipped with a contacting system consisting of a vertical axle driving circular plates into rotation). It is 1.9 m in diameter, with a total height of 9 m, and it is made up of 25 compartments. The aqueous solution circulates from top to bottom in form of dispersed drops. The organic solution or reformate is the continuous phase and it circulates from bottom to top. The number of theoretical extraction stages is 9.

Nearly 95% of the ethanol contained in the aqueous solution is extracted.

The membrane arranged downstream from the extraction allows to remove the water contained in the extract so as to reach a water content in the extract of 0.2 vol. %.

The temperature of the extract at the membrane outlet is 113° C. Considering the performances of the Mitsui membranes described above, 3770 $m^2$ would be necessary to perform such a pervaporation operation at the desired dehydration level.

Cooling of the extract from 150° C. to 113° C. allows to provide vaporization of the water contained in the extract on either side of the membrane.

The dehydration carried out according to the above conditions allows to avoid demixing of the mixture at storage temperatures above 0° C.

Globally, the specifications imposed as regards the maximum ethanol contents in the gasoline are met.

Example 2

According to the Invention

The liquid-liquid extraction is carried out under the same temperature and pressure conditions as in Example 1, with the same reformate as in Example 1 furthermore comprising an oxygen-containing additive (10 wt. % MTBE) introduced at the column bottom.

The extraction balance is given in Table 2.

TABLE 2

| | Aqueous sol. to be treated | Reformate | Extract | Raffinate |
|---|---|---|---|---|
| T (° C.) | 150 | 150 | 150 | 150 |
| P (bars) | 17 | 17 | 17 | 17 |
| EtOH (kg/h) | 1379.74 | 0 | 1369.01 | 10.75 |
| Water (kg/h) | 15,620.26 | 0 | 451.2 | 15,169.06 |
| Reformate (kg/h) | 0 | 31,500 | 31,466.46 | 33.54 |
| MTBE (kg/h) | 0 | 3500 | 3453.61 | 46.39 |
| TOTAL (kg/h) | 17,000 | 35,000 | 36,740.28 | 15,259.74 |
| ratio aqueous sol/ reformate | 0.54 | | | |
| % EtOH extracted | 99 | | | |
| % water extracted | 3 | | | |

The addition of MTBE (10 wt. % MTBE in the reformate) during liquid-liquid extraction allows to extract more ethanol (99% of the ethanol instead of 95% in Example 1) with less reformate (ratio of aqueous solution to be treated/reformate=0.54 instead of 0.27 in Example 1) and limits the extraction of water (3% instead of 15% in Example 1), thus considerably reducing the cost of the reformate drying post-treatment.

Example 3

According to the Invention

The liquid-liquid extraction is carried out under the same temperature and pressure conditions as in Example 1, with the same reformate as in Example 1 furthermore comprising an oxygen-containing additive (10 wt. % MTBE) introduced at an intermediate height, at the level of the $5^{th}$ compartment from the bottom of a column containing 25 compartments.

The extraction balance is given in Table 3.

TABLE 3

| | Aqueous sol. to be treated | Reformate | MTBE | Extract | Raffinate |
|---|---|---|---|---|---|
| T (° C.) | 150 | 150 | 150 | 150 | 150 |
| P (bars) | 17 | 17 | 17 | 17 | 17 |
| EtOH (kg/h) | 1379.74 | 0 | 0.0 | 1368.6 | 11.2 |
| Water (kg/h) | 15,620.26 | 0 | 0.0 | 453.4 | 15,166.8 |
| Reformate (kg/h) | 0 | 31,500 | 0.0 | 31,463.2 | 36.8 |
| MTBE (kg/h) | 0 | 0.0 | 3500.0 | 3499.3 | 0.7 |
| TOTAL (kg/h) | 17,000 | 31,500 | 3500.0 | 36,784.5 | 15,215.5 |
| ratio aqueous sol/ reformate + MTBE | 0.54 | | | | |
| % EtOH extracted | 99.2 | | | | |
| % water extracted | 3 | | | | |

Introducing the MTBE at an intermediate height in the extraction column allows to significantly decrease the amount of MTBE lost in the raffinate.

Example 4

Comparative

This example allows to compare the extraction performances obtained using, on the one hand, a final gasoline or, on the other hand, a cut of the final gasoline rich in aromatics. The liquid-liquid extraction is therefore carried out with the same equipment and under the same temperature and pressure conditions as in Example 1, with a mixture made up of 50 mass % of reformate used before and 50% iso-octane. The mixture used is thus closer to a final gasoline, notably in terms of aromatic compound content (about 40 wt. %). The extraction balance is given in Table 4.

TABLE 4

| | Aqueous sol to be treated | Gasoline | Extract | Raffinate |
|---|---|---|---|---|
| T (° C.) | 150 | 150 | 150 | 150 |
| P (bars) | 17 | 17 | 17 | 17 |
| EtOH (kg/h) | 1737 | — | 1535 | 201 |
| Water (kg/h) | 19,663 | — | 2950 | 16,713 |
| Reformate (kg/h) | 0 | 80,000 | 79,997 | 3 |
| TOTAL (kg/h) | 21,400 | 80,000 | 84,483 | 16,917 |
| ratio aqueous sol/ reformate | 27% | | | |
| % EtOH extracted | 88% | | | |
| % water extracted | 15% | | | |

The ethanol extraction carried out using a final gasoline is not as good as that obtained in Example 1. This illustrates the interest of using an aromatic-rich gasoline cut for the extraction.

The invention claimed is:

1. A method of incorporating alcohol or mixtures of alcohols into a fuel having an aromatic compound content of at least 70 wt. % that is a reformate gasoline cut, a pyrolysis gasoline cut or an LCO type diesel fuel, said method comprising:

liquid-liquid extraction of the alcohol or the alcohol mixture by at least one or more fuels, by directly contacting an aqueous phase containing the alcohol or the alcohol mixture and a hydrocarbon phase comprising said fuel, and drying the fuel enriched in alcohol or alcohol mixture.

2. A method as claimed in claim 1, wherein the alcohol or the alcohol mixture is selected from among ethanol, butanol or an acetone-butanol-ethanol (ABE) mixture.

3. A method as claimed in claim 1, wherein the fuel has an aromatic compound content of at least 80 wt. %.

4. A method as claimed in claim 1, wherein the hydrocarbon phase comprises an oxygen-containing compound or a mixture of oxygen-containing compounds: ETBE (ethyltertiobutylether), MTBE (methyltertiobutylether), TAEE (tertioamyl-ethylether), TAME (tertioamylmethylether), DIPE (diisopropylether), C7 ethers including MEPEME (2-methyl-2-methoxypentane) or DIMEBU (2,3-dimethyl-2-methoxybutane), PTBE (n-propyl tertiobutylether), IPTBE (isopropyltertiobutylether), DPE (dipropylether), or the following alcohols: butanol, TBA (terbutylic alcohol), IPA (isopropylic alcohol), isobutylic alcohol and/or methanol.

5. A method as claimed in claim 1, wherein said aqueous phase containing the alcohol or the alcohol mixture is introduced into a vertical extraction column at the top and said hydrocarbon phase containing the fuel is introduced at the bottom of the extraction column.

6. A method as claimed in claim 1, comprising conducting the liquid-extraction circulating the aqueous phase and the hydrocarbon phase countercurrent by promoting dispersion, contacting and mass transfer.

7. A method as claimed in claim 1, wherein the extraction is carried out at a temperature ranging between the ambient temperature and 320° C., and 200° C., and at a pressure ranging between the atmospheric pressure and 10 MPa.

8. A method as claimed in claim 4, conducted in a vertical column having a bottom and a top and wherein the oxygen-containing compound added to the hydrocarbon phase is introduced at the column bottom into a line delivering the hydrocarbon phase.

9. A method as claimed in claim 4, conducted in a vertical column having a bottom and a top and wherein the oxygen-containing compound added to the hydrocarbon phase is introduced into the extraction column at an intermediate height and is counter-extracted between the aqueous phase and the hydrocarbon phase.

10. A method as claimed in claim 1, further comprising passing raffinate obtained at the end of the extraction to a water treatment plant and/or recycled, and an alcohol-enriched hydrocarbon phase containing an extract is dried.

11. A method as claimed in claim 10, wherein drying the alcohol-enriched hydrocarbon phase is carried out by adsorption on a molecular sieve.

12. A method as claimed in claim 11, wherein drying is carried out by adsorption by circulating an alcohol-free dry fuel directly coming from its manufacturing process in an adsorbent-filled column.

13. A method as claimed in claim 10, wherein the stage of drying the alcohol-enriched fuel is carried out by pervaporation through membranes.

14. A method as claimed in claim 10, wherein during drying the extract is subjected to cooling to separate an alcohol-containing aqueous phase and said aqueous phase is recycled to the extraction column.

15. A method as claimed in claim 1, wherein drying is complemented addition of an oxygen-containing compound or of a mixture of oxygen-containing compounds, prior to storage, said oxygen-containing compound being ETBE (ethyltertiobutylether), MTBE (methyltertiobutylether), TAEE (tertioamylethylether), TAME (tertioamylmethylether), DIPE (diisopropylether), C7 ethers, butanol, TBA (terbutylic alcohol), IPA (isopropylic alcohol), isobutylic alcohol and/or methanol.

16. A method as claimed in claim 1, wherein an extract is obtained that comprises the hydrocarbon phase enriched in anhydrous alcohol or an alcohol mixture is directly incorporated into a gasoline pool.

17. A method according to claim 4, wherein the hydrocarbon phase comprises at least one of the following: ETBE (ethyltertiobutylether), MTBE (methyltertiobutylether), TAEE (tertioamyl-ethylether), TAME (tertioamylmethylether), DIPE (diisopropylether), C7 ethers butanol, TBA (terbutylic alcohol), IPA (isopropylic alcohol), isobutylic alcohol and/or methanol.

18. A method according to claim 7, conducted at a temperature of between 50° C. and 250° C.

19. A method according to claim 7, conducted at a temperature of between 70° C. and 200° C.

20. A method as claimed in claim 15 wherein the C7 ethers are MEPEME (2-methyl-2-methoxypentane) or DIMEBU (2,3-dimethyl-2-methoxybutane), PTBE (n-propyl tertiobutylether), IPTBE (isopropyltertiobutylether), DPE (dipropylether).

21. A method as claimed in claim 17 wherein the C7 ethers are MEPEME (2-methyl-2-methoxypentane) or DIMEBU (2,3-dimethyl-2-methoxybutane), PTBE (n-propyl tertiobutylether), IPTBE (isopropyltertiobutylether), DPE (dipropylether).

* * * * *